US005085369A

United States Patent [19]

Aoki et al.

[11] Patent Number: 5,085,369

[45] Date of Patent: Feb. 4, 1992

[54] FUEL INJECTOR

[75] Inventors: Tsuneaki Aoki; Toshiro Makimura; Kaneo Imamura, all of Obu, Japan

[73] Assignee: Aisan Kogyo Kabushiki Kaisha, Obu, Japan

[21] Appl. No.: 606,904

[22] Filed: Oct. 31, 1990

[30] Foreign Application Priority Data

Nov. 15, 1989 [JP] Japan ..... 1-296382

[51] Int. Cl.[5] ..... B05B 1/26; F02M 51/06

[52] U.S. Cl. ..... 239/5; 239/585; 239/590

[58] Field of Search ..... 239/533.12, 585, 518, 239/525, 590, 1, 5

[56] References Cited

U.S. PATENT DOCUMENTS

| | | | |
|---|---|---|---|
| 4,657,189 | 4/1987 | Iwata et al. | 239/533.17 X |
| 4,771,948 | 9/1988 | Furukawa et al. | 239/533.12 |
| 4,773,374 | 9/1988 | Kiuchi et al. | 239/533.12 X |
| 4,925,110 | 5/1990 | Takeda et al. | 239/533.12 |
| 5,016,819 | 5/1991 | Wood | 239/585 X |
| 5,044,563 | 9/1991 | Mesenich | 239/585 |

FOREIGN PATENT DOCUMENTS

| | | |
|---|---|---|
| 57-152458 | 9/1982 | Japan . |
| 58-90365 | 6/1983 | Japan . |

*Primary Examiner*—Andres Kashnikow
*Assistant Examiner*—Kevin P. Weldon
*Attorney, Agent, or Firm*—Dennison, Meserole, Pollack & Scheiner

[57] ABSTRACT

A fuel injector including a valve housing having a fuel injection hole formed at a front end of the valve housing; a valve movably provided int he valve housing so as to open and close the fuel injection hole; a nozzle fixedly mounted to a front end of the valve housing; and a fuel colliding member provided in the nozzle and positioned in alignment with the fuel injection hole in front thereof. A size of the fuel colliding member is smaller in cross section perpendicular to an axis of the fuel injector than that of the fuel injection hole. Accordingly, a radially inside part of a columnar fuel after collision with the fuel colliding member further collides with a radially outside part of the columnar fuel passing outside the fuel colliding member to accelerate atomization of the fuel without reducing a velocity of flow of the fuel.

6 Claims, 6 Drawing Sheets

FUEL INJECTOR

BACKGROUND OF THE INVENTION

The present invention relates to a fuel injector for supplying atomized fuel to an internal combustion engine, and more particularly to such a fuel injector improved in fuel atomization.

In general, it is desirable to finely particulate or atomize the fuel to be supplied to the engine, so as to improve a fuel combustion efficiency, which contributes to an improvement in fuel consumption and emission control.

It is known that a fuel colliding member for atomizing a columnar fuel injected from a fuel injection hole of the fuel injector is positioned in alignment with the fuel injection hole in front thereof. By the provision of the fuel colliding member as mentioned above, the columnar fuel injected from the fuel injection hole collides with the fuel colliding member to be finely particulated or atomized.

The fuel colliding member is formed in various shapes such as circular, spherical and conical shapes (see Japanese Utility Model Laid-open Publication Nos. 57-152458 and 58-90365, for example). In the conventional fuel colliding member having any shape, a size in cross section perpendicular to an axis of the fuel injector is larger than that of the fuel injection hole, so that all the parts of the columnar fuel injected from the fuel injection hole collide with the fuel colliding member to be atomized.

FIG. 1A shows an example of the prior art fuel injector, in which it is appreciated that a columnar fuel F injected from a fuel injection hole 6 entirely collides with a fuel colliding member 34A to be atomized.

The present inventors have investigated to find that when an outer diameter $\phi a$ of the fuel colliding member 34A is larger than a diameter $\phi d$ of the fuel injection hole 6, all the columnar fuel is sufficiently atomized by the collision with the fuel colliding member 34A, but the atomized fuel is diffused radially outwardly to be deposited onto an inner wall surface 22 of a nozzle 21, resulting in insufficient atomization of the fuel to be sprayed from the nozzle 21. Furthermore, it has been also found that a velocity of the atomized fuel to be sprayed from the nozzle 21 is reduced to elongate a time for making the atomized fuel reach the engine.

SUMMARY OF THE INVENTION

It is an object of the present invention to provide a fuel injector improved in fuel atomization.

It is another object of the present invention to provide a fuel injector which can ensure a high velocity of atomized fuel.

According to the present invention, there is provided in a fuel injector including a valve housing having a fuel injection hole formed at a front end of said valve housing; a valve movably provided in said valve housing so as to open and close said fuel injection hole; a nozzle fixedly mounted to the front end of said valve housing; and a fuel colliding member provided in said nozzle and positioned in alignment with said fuel injection hole in front thereof; the improvement characterized in that a size of said fuel colliding member is smaller in cross section perpendicular to an axis of said fuel injector than that of said fuel injection hole.

In operation, a radially inside part of a columnar fuel injected from the fuel injection hole collides with the fuel colliding member to be atomized in a first stage.

The atomized fuel is diffused radially outwardly to further collide with a radially outside part of the columnar fuel injected from the fuel injection hole passing outside the fuel colliding member. As a result, the radially outside part of the columnar fuel is atomized in a second stage by the atomized fuel diffused after collision with the fuel colliding member. Thus, all the parts of the columnar fuel injected from the fuel injection hole is sufficiently atomized. In the above second stage, a high velocity of flow of the radially outside part upon collision with the atomized fuel obtained in the first stage is almost maintained, thereby ensuring a high injection velocity of atomized fuel to be injected from the nozzle.

The invention will be more fully understood from the following detailed description and appended claims when taken with the drawings.

DETAILED DESCRIPTION OF THE PREFERRED EMBODIMENTS

Figure 2:
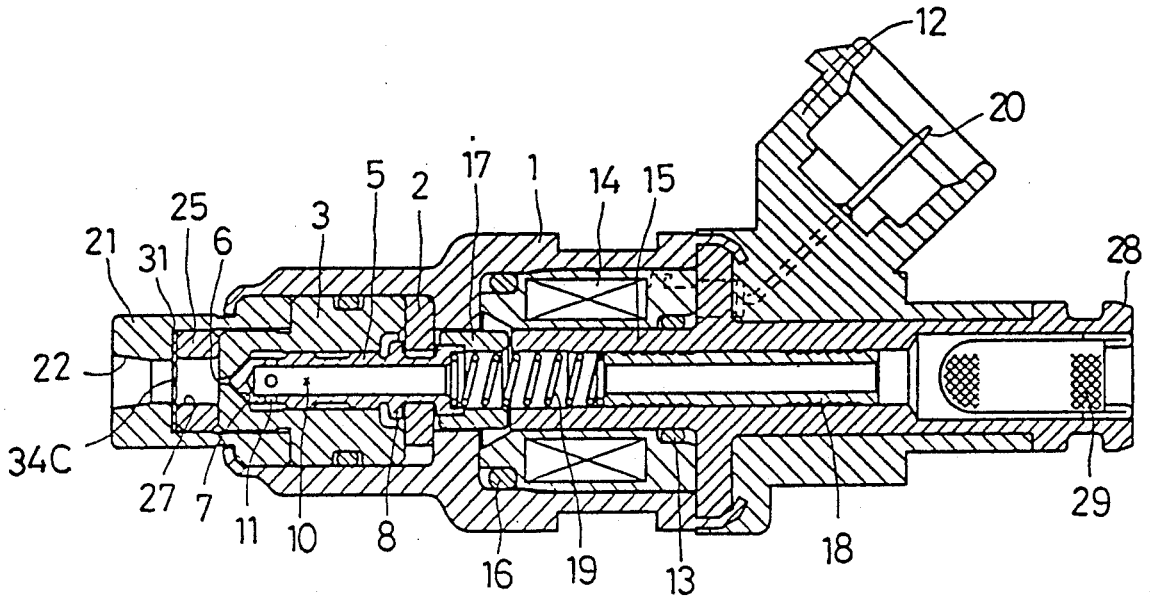
FIG. 2 is a vertical sectional view of a preferred embodiment of the fuel injector according to the present invention.

Referring now to FIG. 2 which shows a general construction of the fuel injector according to the present invention, a valve housing 3 is mounted through a stopper 2 in a front portion of a casing 1. The valve housing 3 is formed at its front end with a fuel injection hole 6 and a valve seat 7 constructed of a tapering conical surface continuing to the fuel injection hole 6.

A valve 5 is axially movably mounted in the valve housing 3. The valve 5 is formed at its front end with a substantially conical surface 4 operatively abutting against the conical valve seat 7. The valve 5 is formed at its rear portion with a flange 8 operatively abutting against the stopper 2. Thus, a movable stroke of the valve 5 is limited between the valve seat 7 and the stopper 2. More specifically, when the valve 5 is operated to advance to the fuel injection hole 6 until the front conical surface 4 of the valve 5 comes into abutment against the valve seat 7, the valve 5 is closed to stop injection of fuel from the fuel injection hole 6. On the other hand, when the valve 5 is operated to retract from the fuel injection hole 6 until the flange 8 of the valve 5 comes into abutment against the stopper 2, the valve 5 is opened to inject the fuel from the fuel injection hole 6. The valve 5 is formed with an axial central fuel passage 10 and a plurality of radial fuel passages 11 communicating with the fuel injection hole 6.

A solenoid coil 14 is mounted through an O-ring seal 16 in a rear portion of the casing 1. A fixed core 15 formed of a ferromagnetic material is inserted in the solenoid coil 14 through an O-ring seal 13. The fixed core 15 has a central bore serving as a fuel supply passage. The solenoid coil 14 is electrically connected through a terminal 20 of a connector 12 to an external circuit (not shown).

An armature 17 is fixedly mounted over a rear end of the valve 5 so as to be magnetically attracted to the fixed core 15 by excitation of the solenoid coil 14.

A fuel supply pipe 18 is fixedly inserted in the central bore of the fixed core 15 and is positioned therein. A compression spring 19 is interposed between a front end of the fuel supply pipe 18 and a shouldered rear end portion of the valve 5. The compression spring 19 normally biases the valve 5 with the armature 17 so as to retract the armature 17 from the fixed core 15 and make the front conical surface 4 of the valve 5 abut against the valve seat 7.

The fixed core 15 is integrally formed at its rear end with a plug 28 to be connected to a fuel delivery pipe (not shown). A fuel strainer 29 is disposed in the plug 28.

Figure 1A:
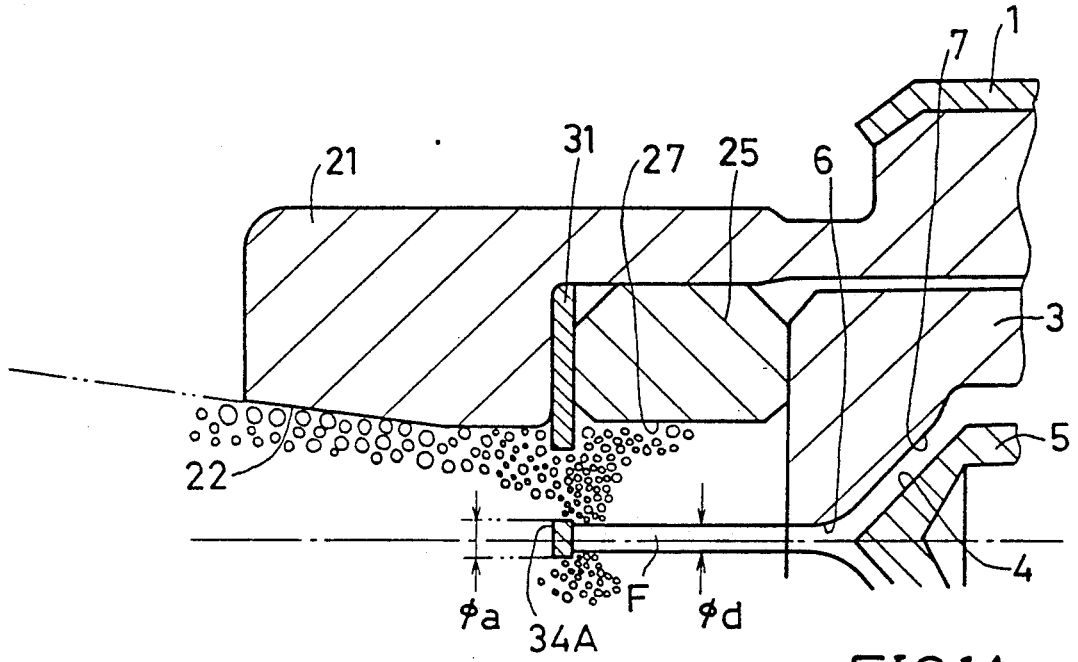
FIG.1A PRIOR ART
FIG. 1A is an enlarged sectional view, partly cut away, of a front end portion of the fuel injector in the prior art, showing a fuel atomized condition.
Figure 1B:
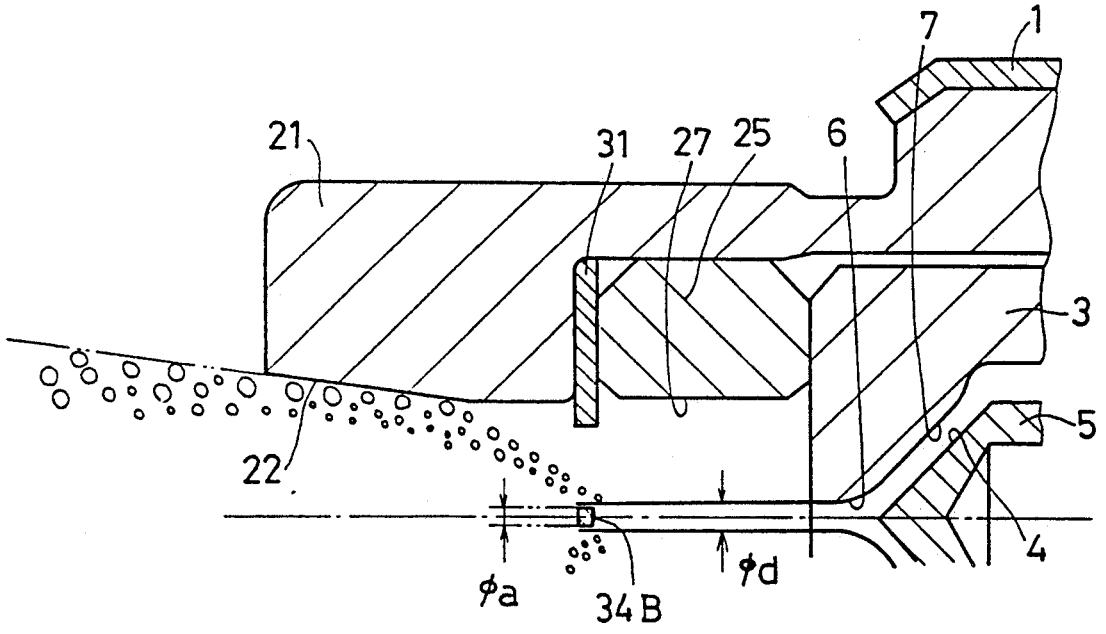
FIG. 1B is a view similar to FIG. 1A, showing the case that the ratio $\phi a/\phi d$ is greater than 0.9 according to the present invention.
Figure 1C:
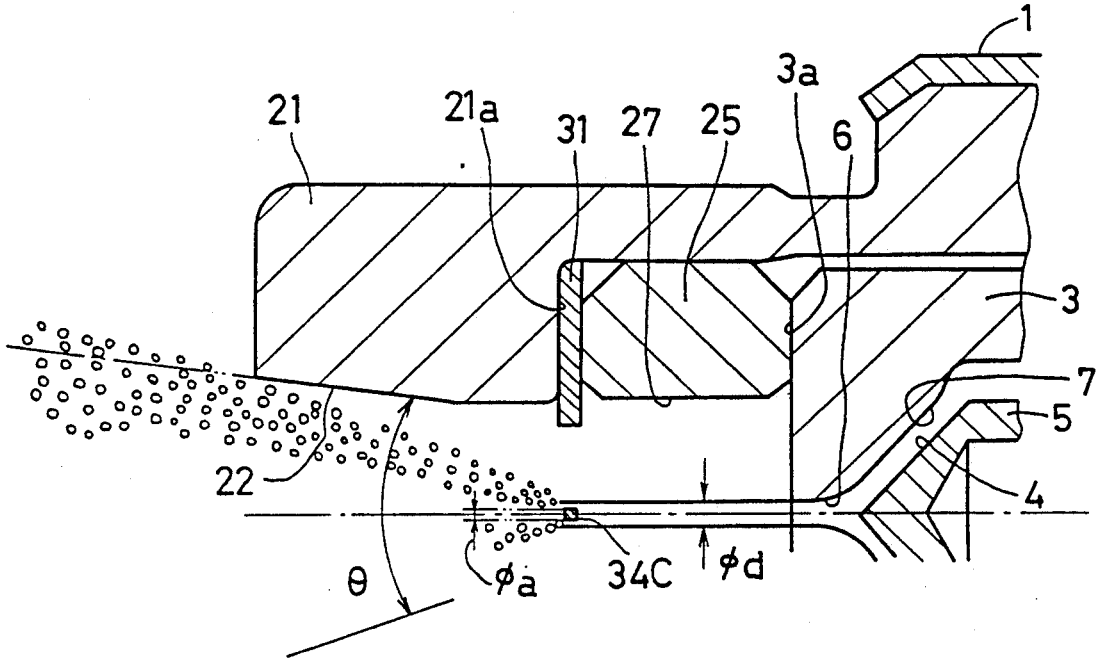
FIG. 1C is a view similar to FIG. 1A, showing the case that the ratio $\phi a/\phi d$ is in the range of 0.1 to 0.9 according to the present invention.

Referring next to FIG. 1C which shows an essential part of a preferred embodiment of the present invention in connection with FIG. 2, a nozzle 21 is fixedly mounted to a front end portion of the valve housing 3 at the front end of the casing 1. The nozzle 21 is formed at its front end portion with a conically diverging nozzle hole 22 aligned with the fuel injection hole 6. The nozzle hole 22 has a predetermined tapering angle $\theta$ such that an atomized fuel formed in the nozzle 21 can be supplied to a circular area at a predetermined distance (see FIG. 4). The tapering angle $\theta$ of the nozzle hole 22 may be suitably selected so as to obtain a desired spray angle of the atomized fuel.

A cylindrical spacer 25 and a circular atomizer plate 31 are interposed between a front end surface 3*a* of the valve housing 3 and a shoulder surface 21*a* of the nozzle 21. The cylindrical spacer 25 is formed with a communication hole 27 for communicating the fuel injection hole 6 with the nozzle hole 22. The communication hole 27 has a diameter substantially equal to that of a rear end portion of the nozzle hole 22. The circular atomizer plate 31 is sandwiched between a front end of the spacer 25 and the shoulder surface 21*a* of the nozzle 21. An assembly of the nozzle 21 with the spacer 25 and the atomizer plate 31 is obtained by inserting the atomizer plate 31 into the nozzle 21 from a rear open end until the atomizer plate 31 comes into abutment against the shoulder surface 21*a* of the nozzle 21, and then press-fitting the spacer 25 into the nozzle 21 until the spacer 25 comes into abutment against the atomizer plate 31. Thereafter, the assembly is fixed to the casing 1 by inserting a rear end portion of the nozzle 21 and caulking the front end of the casing 1 to the outer circumference of the nozzle 21.

Figure 3:
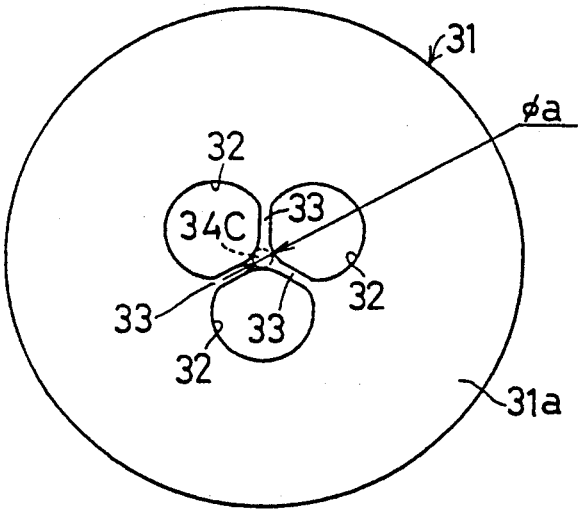
FIG. 3 is a plan view of a fuel atomizer plate shown in FIG. 2.

Referring to FIG. 3 which shows the atomizer plate 31 in plan, the atomizer plate 31 is formed at its central portion with substantially circular three atomizer holes 32 partitioned circumferentially equally at 120 degrees by three bridging portions 33 extending in a radial direction. The three bridging portions 33 are joined together at the center of the atomizer plate 31 to form a circular fuel colliding portion 34C. The atomizer plate 31 is formed by pressing or punching a steel blank, for example.

As apparent from FIG. 1C, the fuel colliding portion 34C is aligned to the fuel injection hole 6, so that the fuel columnarly injected from the fuel injection hole 6 collides with the fuel colliding portion 34C to thereby atomize the columnar fuel. In this preferred embodiment, a ratio of an outer diameter $\phi a$ of the fuel colliding portion 34C to a diameter $\phi d$ of the fuel injection hole 6 is set to $0.1 \leqq \phi a/\phi d \leqq 0.9$.

Figure 4:
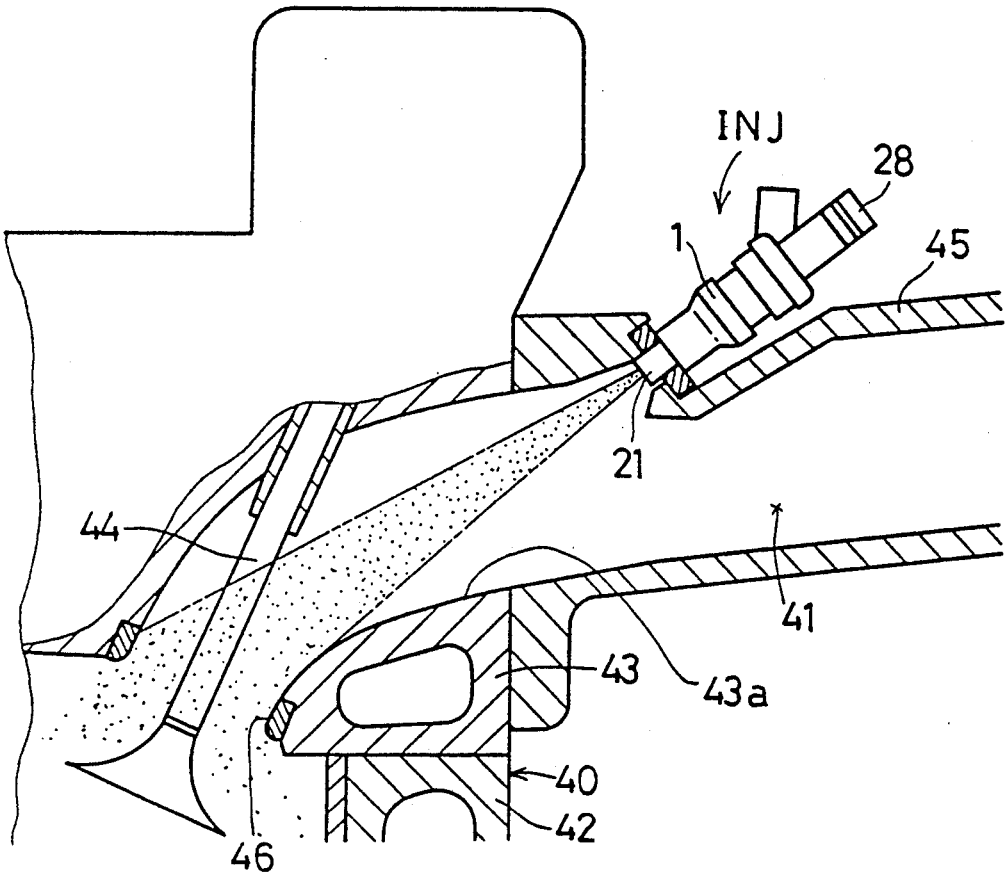
FIG. 4 is a partially sectional side view of a mounting structure of the fuel injector to an internal combustion engine, showing a fuel atomized condition.

Referring to FIG. 4, the fuel injector INJ is provided on a suction passage 41 of an intake manifold 45 connected to an internal combustion engine 40 having a cylinder block 42 and a cylinder head 43. The cylinder head 43 is formed with an intake passage 43*a* communicated at its upstream end with the suction passage 41 of the intake manifold 45 and communicated at its downstream end with an intake port 46. The casing 1 of the fuel injector INJ is fixedly mounted to the intake manifold 45 so that the nozzle 21 is directed to the intake port 46.

In operation, when the solenoid coil 14 is in an unexcited condition, the valve 5 is closed by the biasing force of the compression spring 19. Accordingly, although the fuel is pumped through the fuel delivery pipe into the fixed core 15 and the valve 5, it is not injected from the fuel injection hole 6.

When the solenoid coil 14 is excited, the armature 17 is magnetically attracted to the fixed core 15 against the biasing force of the compression spring 19 to thereby open the valve 5. Accordingly, the fuel in the valve 5 is columnarly injected under a metered condition from the fuel injection hole 6 through the communication hole 27 of the spacer 25 to the fuel colliding portion 34C of the fuel atomizer plate 31. By the collision of the fuel against the fuel colliding portion 34C, the fuel is atomized, and as shown in FIG. 4, the atomized fuel thus obtained is injected from the nozzle hole 22 of the nozzle 21 through the suction passage 41 and the intake passage 43*a* to the intake port 46.

The fuel atomized condition to be obtained in the nozzle 21 depends on the ratio of the outer diameter $\phi a$ of the fuel colliding portion 34C to the diameter $\phi d$ of the fuel injection hole 6. The present inventors have tested a most preferable range of such a ratio $\phi a/\phi d$ to be required to obtain a satisfactory atomized condition. That is, the test was carried out by changing the outer diameter $\phi a$ of the fuel colliding portion 34C with the diameter $\phi d$ of the fuel injection hole 6 set to 0.46 mm to thereby change the ratio $\phi a/\phi d$, and measuring an average particle size of the atomized fuel for each ratio. The measurement of the average particle size was carried out by detecting the same at a position distant from the front end of the nozzle 21 by means of a known particle size distribution measuring device utilizing a laser beam diffraction method. Further, a distance between the fuel injection hole 6 and the fuel colliding portion 34C was set to 2.8 mm.

Figure 5:
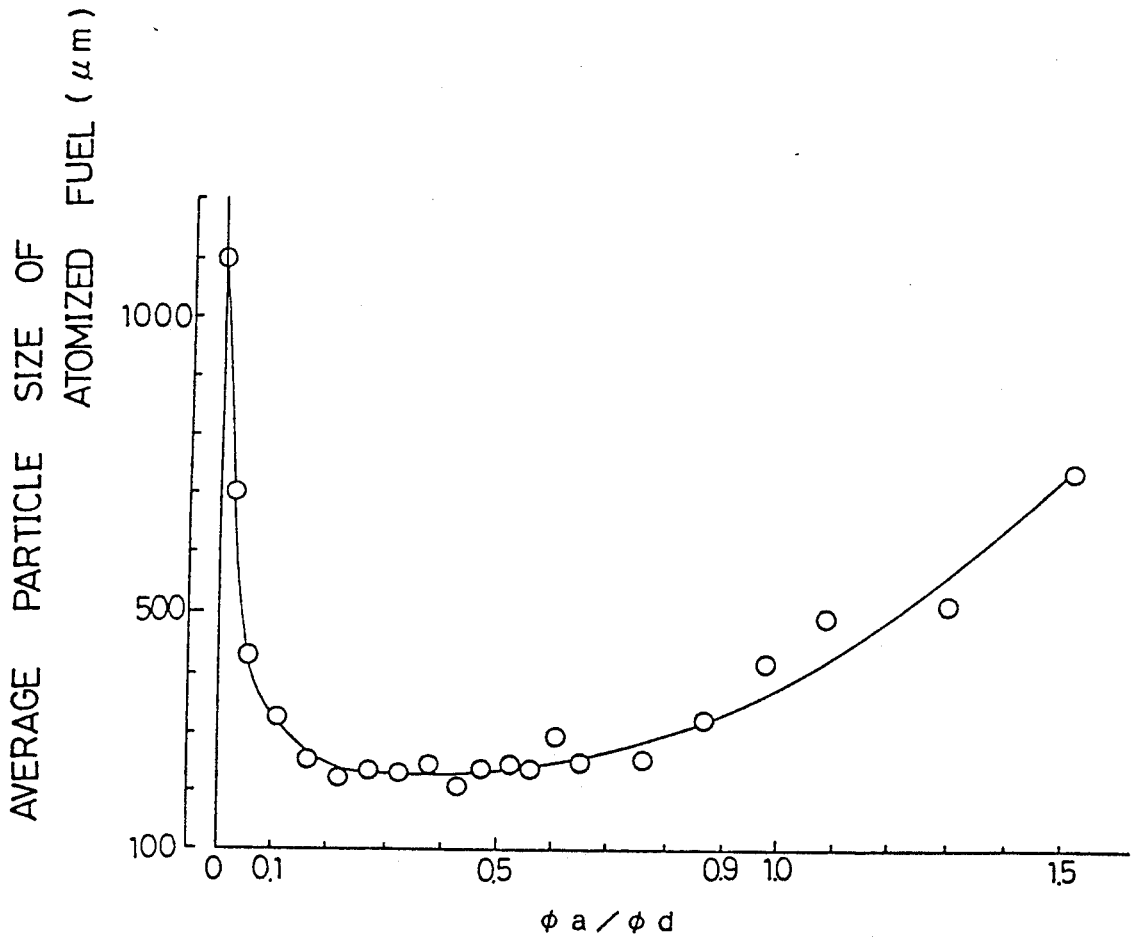
FIG. 5 is a graph showing the relationship between the ratio $\phi a/\phi d$ and an average particle size of atomized fuel.

The test result is shown in FIG. 5. As apparent from FIG. 5, the average particle size of the atomized fuel is small (less than about 350 microns) in the $\phi a/\phi d$ range of 0.1 to 0.9 as compared with the other ranges less than 0.1 and greater than 0.9.

Figure 1D:
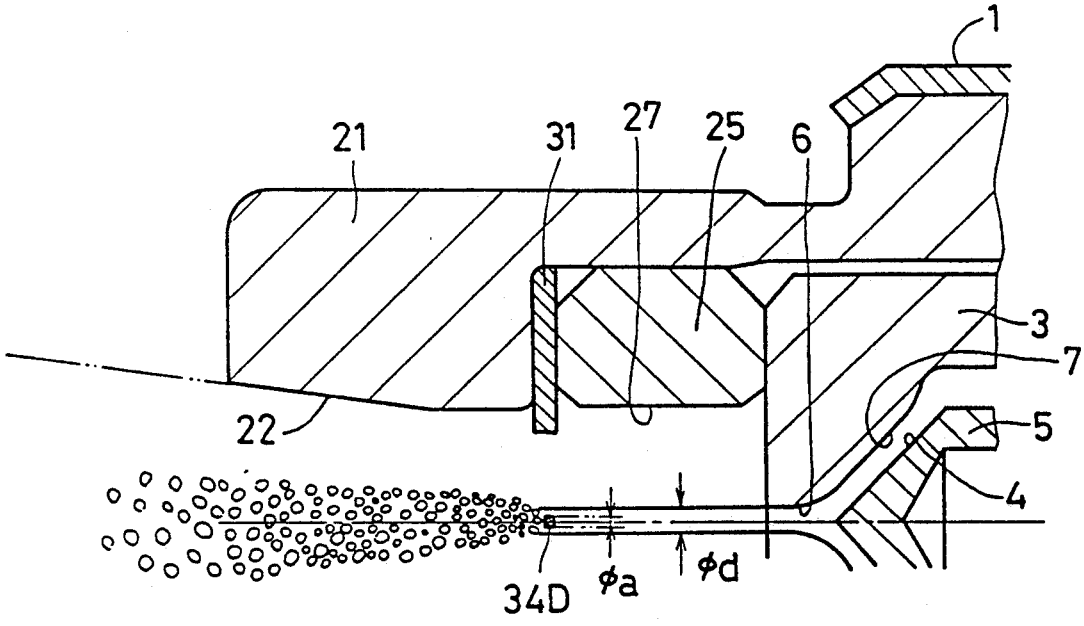
FIG. 1D is a view similar to FIG. 1A, showing the case that the ratio $\phi a/\phi d$ is less than 0.1 according to the present invention.

It is considered that the fuel atomized condition is not satisfactory in the $\phi a/\phi d$ ranges less than 0.1 and greater than 0.9 for the following reasons. That is, in the case of the range less than 0.1 as shown in FIG. 1D, as the columnar fuel passing outside a fuel colliding portion 34D is relatively large in cross section perpendicular to an axis of the fuel injector, diffusion of the fuel particles after collision with the fuel colliding portion 34D is suppressed by the columnar fuel having a high velocity. On the other hand, in the case of the range greater than 0.9 as shown in FIG. 1B, there is a possibility that the fuel particles after collision with a fuel colliding portion 34B will be deposited onto the inner wall surface 22 of the nozzle 21.

The distance between the fuel injection hole 6 and the fuel colliding portion 34C can be suitably selected to a value within a predetermined range (e.g., 0.5 to 3.0 mm).

Figure 6:
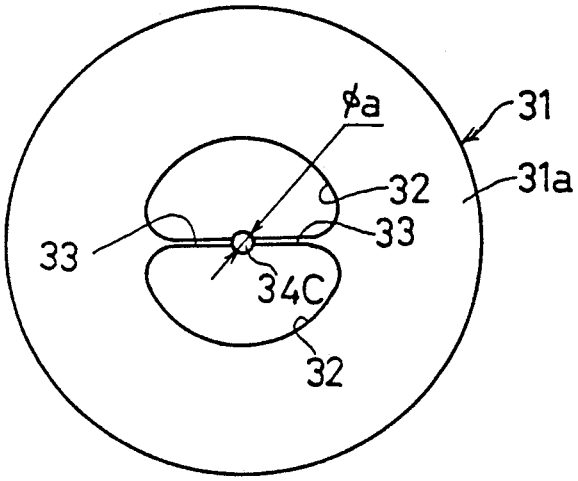
FIG. 6 is a view similar to FIG. 3, showing a modification of the fuel atomizer plate.

The number of the bridging portions 33 of the fuel atomizer plate 31 can be suitably modified. FIG. 6 shows such a modification of the fuel atomizer plate 31, in which two bridging portions 33 are formed at 180 degrees apart from each other so as to define two semicircular fuel atomizer holes 32 and form a fuel colliding portion 34C at the joining portion thereof.

It is preferable to make a width of each bridging portion 33 as small as possible (e.g., 0.15 mm) for the purpose of ensuring smooth diffusion of the atomized fuel.

Further, the assembly of the nozzle 21, the spacer 25 and the fuel atomizer plate 31 may be integrally formed of synthetic resin.

Having thus described the preferred embodiments of the invention, it should be understood that numerous structural modifications and adaptations may be made without departing from the spirit of the invention.

What is claimed is:

1. In a fuel injector including:

a valve housing having a fuel injection hole formed at a front end of said valve housing;

a valve movably provided in said valve housing so as to open and close said fuel injection hole;

a nozzle fixedly mounted to the front end of said valve housing; and a fuel colliding member provided in said nozzle and positioned in alignment with said fuel injection hole in front thereof;

the improvement characterized in that said fuel colliding member comprises a plate like member formed at a central joining portion of a plurality of bridging portions extending from a side of inner circumferential face of said nozzle to center, and that a size of said fuel colliding member is smaller in cross section perpendicular to an axis of said fuel injector than that of said fuel injection hole.

2. The fuel injector as defined in claim 1, wherein said fuel colliding member comprises a circular plate, and a ratio of an outer diameter $\phi a$ of said circular plate to a diameter $\phi d$ of said fuel injection hole is in the range of $0.1 \leqq \phi a/\phi d \leqq 0.9$.

3. The fuel injector as defined in claim 1, wherein said fuel colliding member comprises a circular atomizer plate having three atomizer holes partitioned circumferentially equally at 120 degrees by three bridging portions extending in a radial direction and having a circular fuel colliding portion formed at a central joining portion of said three bridging portion.

4. The fuel injector as defined in claim 1, wherein said fuel colliding member comprises a circular fuel atomizer plate having two atomizer holes partitioned circumferentially equally at 180 degrees by two bridging portions extending in a radial direction and having a circular fuel colliding portion formed at a central joining portion of said two bridging portions.

5. In a fuel injector including:

a valve housing having a fuel injection hole formed at a front end of said valve housing;

a valve movably provided in said valve housing so as to open and close said fuel injection hole;

a nozzle fixedly mounted to the front end of said valve housing; and a fuel colliding member provided in said nozzle and positioned in alignment with said fuel injection hole in front thereof;

the improvement characterized in that said fuel colliding member comprises a plate like member formed at a central joining portion of a plurality of bridging portions extending from a side of inner circumferential face of said nozzle to center, and has a size in cross section such that a radially inside part of a columnar fuel injected from said fuel injection hole collides with said fuel colliding member, whereby said radially inside part of said columnar fuel after collision with said fuel colliding member further collides with a radially outside part of said columnar fuel passing outside said fuel colliding member to accelerate atomization of said fuel while substantially maintaining velocity of flow of said fuel.

6. A fuel atomizing method in a fuel injector including:

a valve housing having a fuel injection hole formed at a front end of said valve housing;

a valve movably provided in said valve housing so as to open and close said fuel injection hole;

a nozzle fixedly mounted to the front end of said valve housing; and a fuel colliding member provided in said nozzle and positioned in alignment with said fuel injection hole in front thereof;

said method comprising the steps of making a radially inside part of a columnar fuel injected from said fuel injection hole collide with said fuel colliding member, and making said radially inside part of said columnar fuel after collision with said fuel colliding member further collide with a radially outside part of said columnar fuel passing outside said fuel colliding member, whereby atomization of said fuel is accelerated while substantially maintaining velocity of flow of said fuel.

* * * * *